US005120922A

United States Patent [19]

Brouillette

[11] Patent Number: 5,120,922

[45] Date of Patent: Jun. 9, 1992

[54] MOMENTARY PUSHBUTTON SLIDE SWITCH

[75] Inventor: Peter F. Brouillette, Manchester, N.H.

[73] Assignee: Augat Inc., Attleboro, Mass.

[21] Appl. No.: 659,852

[22] Filed: Feb. 22, 1991

[51] Int. Cl.[5] ..... H01H 19/46; H01H 15/02

[52] U.S. Cl. ..... 200/519; 200/548; 200/549; 200/547

[58] Field of Search ..... 200/519, 548, 549, 547, 200/550, 551, 536, 539, 540, 541, 556, 563, 16 F, 16 R, 565, 254, 255, 256, 282, 291, 323, 324, 325

[56] References Cited

U.S. PATENT DOCUMENTS

| | | | |
|---|---|---|---|
| 2,464,184 | 3/1949 | Pearce | 200/549 X |
| 3,511,952 | 5/1970 | Wickinson | 200/291 |
| 4,393,283 | 7/1983 | Masuda | 200/254 |
| 4,816,626 | 3/1989 | Valenzana et al. | 200/550 X |
| 4,871,885 | 10/1989 | Kamada | 200/547 X |

*Primary Examiner*—Henry J. Recla
*Assistant Examiner*—David J. Walczak
*Attorney, Agent, or Firm*—Weingarten, Schurgin, Gagnegin & Hayes

[57] ABSTRACT

A momentary pushbutton multiposition slide switch is provided which can be readily manufactured in miniature size from substantially fewer components than switches of conventional construction while providing the same electrical functionality. The switch includes a slider assembly that provides three switch positions: a normally open position, a position providing switch closure between first fixed contacts and a switch position providing switch closure between second fixed contacts. The slider assembly includes a slider contact that is carried by an assembly body, the slide contact selectively bridges fixed contacts to be interconnected at each slide position. The slider assembly also includes a pushbutton that incorporates a detent portion. In one embodiment, the detent portion is cooperative with a complenentary detent portion of a resilient contact element. In an alternate embodiment, the detent portion includes a ball and spring assembly that is cooperative with recesses in a confronting wall of a switch housing. Depression of the pushbutton causes engagement of the resilient contact element with a cooperative fixed contact to provide momentary switch closure. The fixed contacts are retained on an insulative mounting board that is secured to the switch housing which also supports the slide assembly. The fixed contacts terminate in external leads or terminals for connection to associated circuitry.

6 Claims, 8 Drawing Sheets

MOMENTARY PUSHBUTTON SLIDE SWITCH

FIELD OF THE INVENTION

This invention relates to electrical switches and more particularly to momentary pushbutton multiposition slide switches.

BACKGROUND OF THE INVENTION

Pushbutton electrical switches are generally known for providing opening and/or closing of switch contacts in response to depression of an actuating pushbutton. In pushbutton switches of the momentary type, the pushbutton is actuated for so long as it is manually depressed, and is returned to its original position by a biasing force. Slide switches are also known for providing selection of two or more switch positions for engagement of respective switch contacts. Slide switch operation can occur in conjunction with pushbutton operation to provide momentary pushbutton switch actuation in each of the slide switch positions. Such switches are relatively complex and require a detent mechanism for maintaining the slider in respective positions, as well as a separate spring mechanism for biasing of the momentary pushbutton. As an example, a three-position pushbutton slide switch of conventional construction requires three steel balls and three compression springs to provide the detent and biasing mechanisms, respectively. With the increasing need for miniature switches for small electronic devices such as pocket pagers, there is a need for switches of simplified construction having relatively few parts for simplicity and ease of manufacture and performance. Such simplified construction also results in reduced cost of manufacture.

SUMMARY OF THE INVENTION

This invention comprises a momentary pushbutton multi-position slide switch that can be readily manufactured in miniature size and which contains substantially fewer components than switches of conventional construction, while providing the same electrical functionality. The improved switch of the present invention comprises a slider assembly which includes a manually operative pushbutton that, in each slide position, can be depressed to provide momentary switch actuation. At each slide position, separate switch actuation is provided between associated electrical contacts. In the illustrated embodiment, the slider assembly provides three switch positions, an open position, a position providing switch closure between first contacts, and a switch position providing switch closure between second contacts. At each of the slide positions the momentary pushbutton is operative to provide a switch closure between an additional set of contacts.

The slider assembly includes a slider contact movable with the assembly body for selectively bridging fixed contacts to be interconnected at each slide position. The slider assembly also includes a pushbutton that incorporates detent means. In one embodiment, the detent means is cooperative with a detent portion of a resilient contact element for causing depression and engagement of the resilient contact element with a cooperative fixed contact to provide momentary switch closure. The fixed contacts are retained on an insulative mounting board that is secured to a switch housing which also supports the slider assembly. The fixed contacts terminate in outwardly extending leads or other terminals for connection to associated circuitry. In an alternate embodiment, the detent means includes a ball and spring assembly that is cooperative with recesses in a wall of the switch housing that confronts the ball and spring assembly.

DESCRIPTION OF THE DRAWING

The invention will be more fully understood from the following detailed description taken in conjunction with the accompanying figures, wherein.

DETAILED DESCRIPTION OF THE INVENTION

Figure 1:
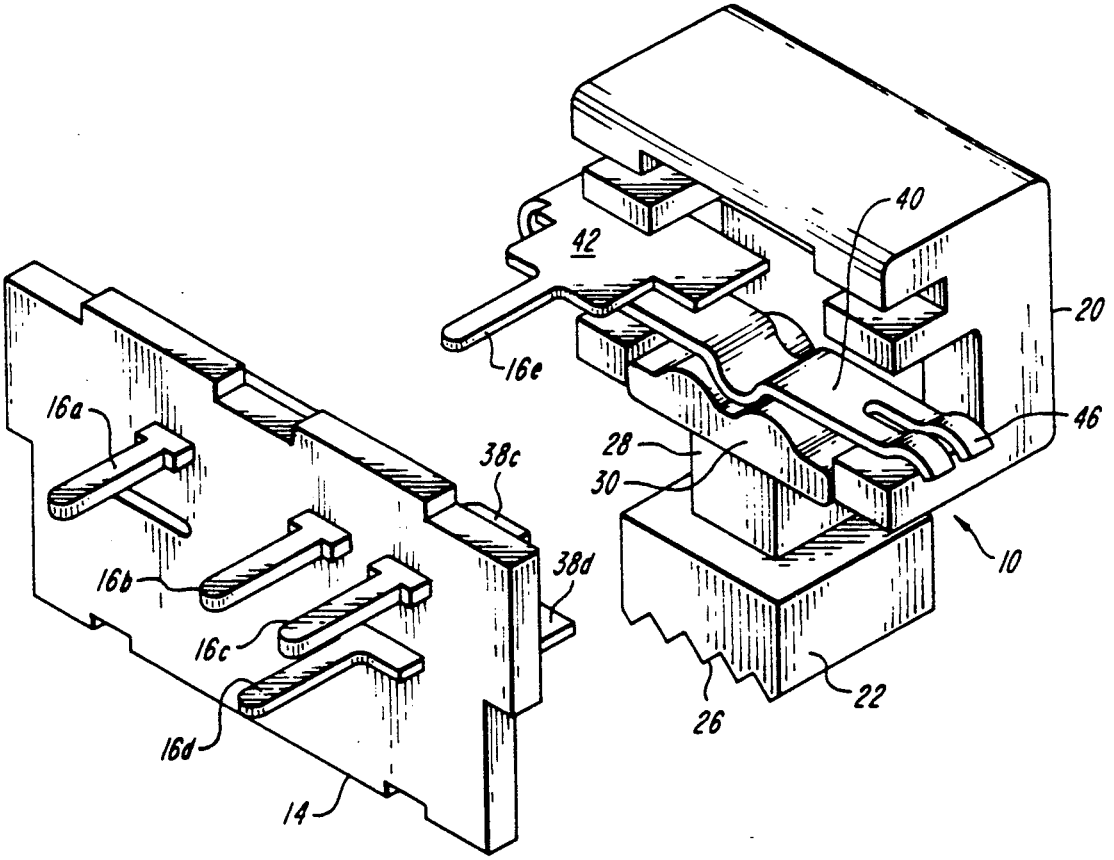
FIG. 1 is an exploded view of the novel pushbutton multiposition slide switch according to the invention, without showing the switch housing.

Referring to the drawing figures, there is shown a preferred embodiment of the invention including a slider assembly 10 mounted in a switch housing 12 to which is secured a mounting board 14 that contains terminals 16 by which the switch is connected to associated circuitry. The slider assembly 10 includes a slider body 20 fabricated of electrically insulating material, typically a molded plastic such as a glass reinforced Nylon 6/6. A pushbutton 22 is also fabricated of an electrically insulative material and is cooperative with the body 20 to provide movement along an axis illustrated by arrows 24. The pushbutton 22 includes an actuating end 26 operative to be engaged by a finger of a user, an intermediate portion 28, and an inner end portion 30 having spaced recesses 32*a*, 32*b*, and 32*c*. A contact element 34 is retained within a cooperative recess 36 of body 20 for providing a sliding electrical contact in a manner to be explained further below.

Figure 3:
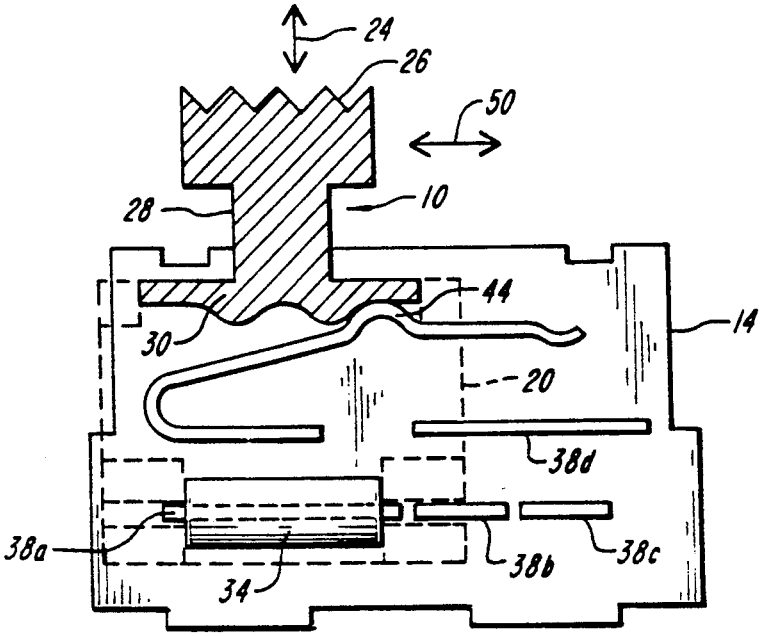
FIG. 3 is a partly sectioned cut-away view of the switch in a first slide switch position.
Figure 4:
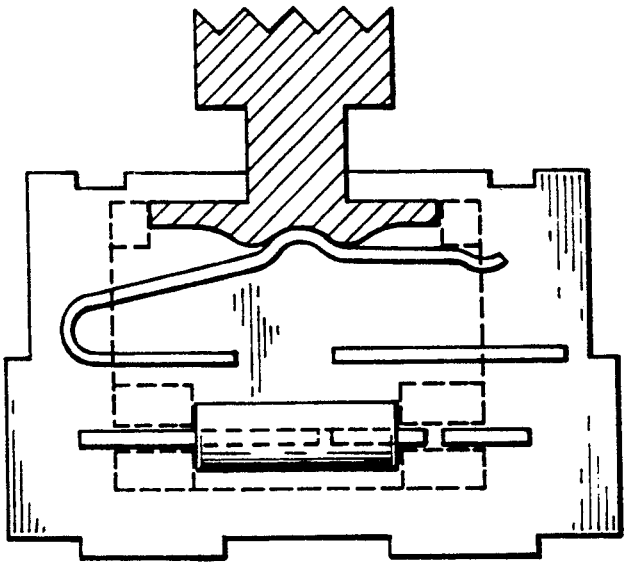
FIG. 4 is a partly sectioned cut-away view of the switch in a second slide switch position.
Figure 5:
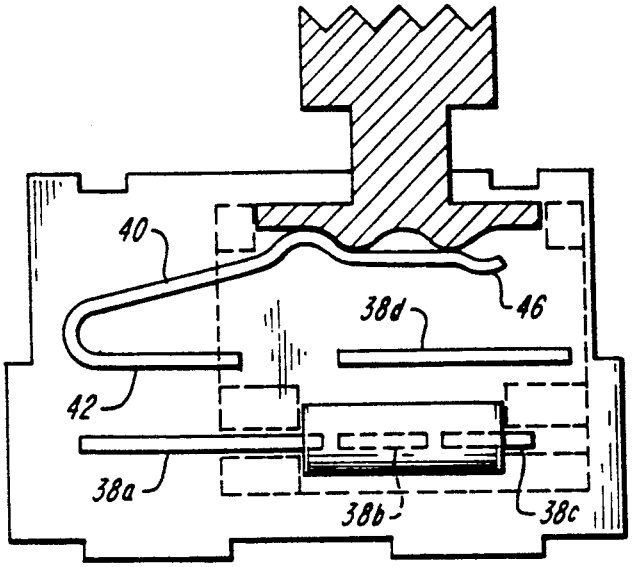
FIG. 5 is a partly sectioned cut-away view of the switch in a third slide switch position.
Figure 6:
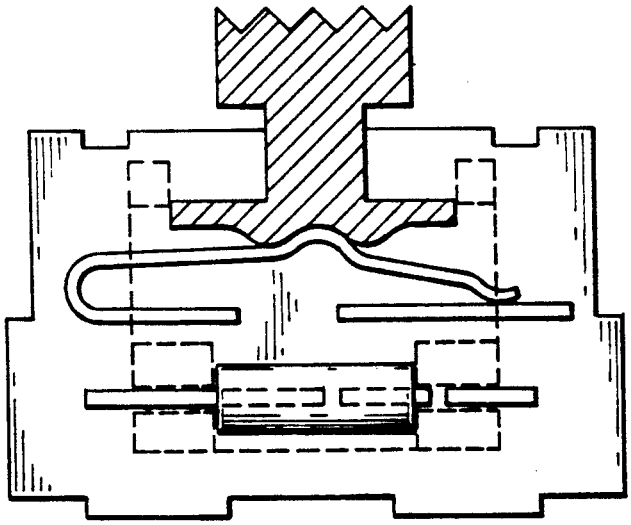
FIG. 6 is a partly sectioned cut-away view of the switch with the slider in the same position as shown in FIG. 4, and with the pushbutton depressed for momentary switch actuation.
Figure 7:
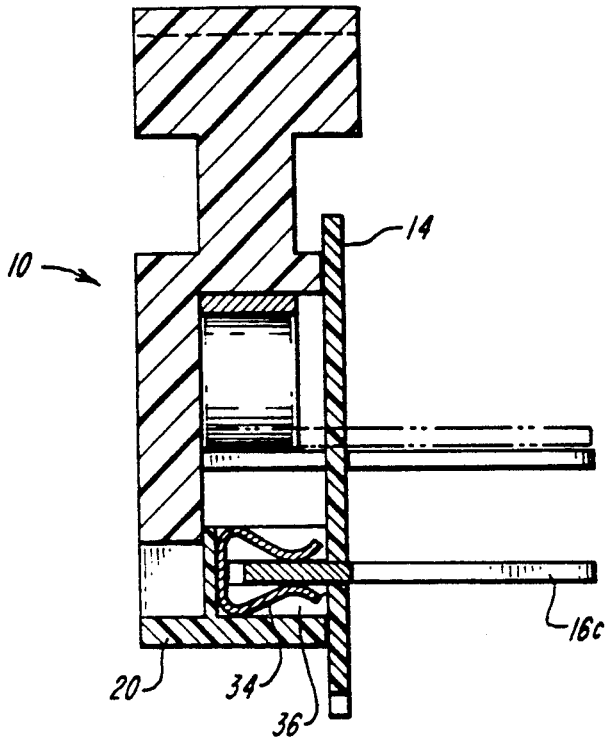
FIG. 7 is a sectional view taken along the section lines shown in FIG. 4.
Figure 8:
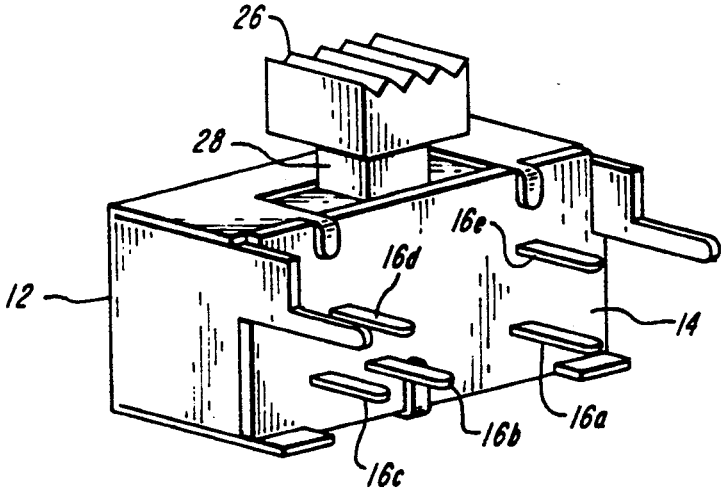
FIG. 8 is a perspective view of the switch enclosed within its housing.

The mounting board 14 is made of an insulative material such as phenolic, and contains a plurality of fixed contacts 38, each associated with a respective terminal or lead 16. The contacts 38 and leads 16 are preferably formed as an integral element of a suitable conductive material such as brass. In the illustrated embodiment, three contacts 38*a* through 38*c* are disposed along a single linear axis. The contact 38*a* is longer than the other contacts for reasons to be explained. A resilient contact element 40 is disposed on the mounting board 14 and is retained therein by a mounting end 42 secured to the board 14 and terminating in a terminal 16*e*. The resilient contact element 40 functions as a leaf spring. The contact element 40 also includes a raised or projecting portion 44 which is cooperative with recesses 32 of the pushbutton, and a contact end 46 which is cooperative with a fixed contact 38*d* that is mounted to the board 14 and terminates in a terminal 16*d*. The resilient contact element 40 is formed of a suitable conductive material having requisite spring characteristics such as beryllium copper, and assumes a normally open position wherein the contact end 46 is spaced apart from associated fixed contact 38*d*, as illustrated in FIGS. 3-5.

The sliding contact 34 is operative to selectively interconnect the fixed contacts 38*a*, 38*b*, and 38*c*. With the slider in the position illustrated in FIG. 3, the sliding contact 34 is disposed only upon contact 38*a*. Thus, in this slide switch position, there is no interconnection among any of the contacts 38*a*, 38*b* and 38*c*. In the center slide switch position illustrated in FIG. 4, the sliding contact 34 bridges and engages fixed contacts 38*a* and 38*b* to provide electrical interconnection therebetween. In the slide switch position illustrated in FIG. 5, the sliding contact 34 engages all three contacts 38*a*, 38*b*, and 38*c* to provide electrical interconnection among these contacts. It will be appreciated that other switch configurations can be provided in a switch according to the present invention. The switch can be implemented with less than three slide positions or more than three slide positions, and the relative length of the fixed contacts 38 in relation to the sliding contact 34 can be determined to provide selective interconnection at any switch position.

In response to a lateral force applied to the pushbutton actuating end 26 by the finger or fingers of a user, generally along an axis indicated by arrows 50, the slider assembly 10 is movable to any of three positions defined by recesses 32*a*, 32*b* and 32*c*. These slide positions are defined by the latching or detenting action of each of the recesses in cooperation with the projection 44 of the resilient contact 40. In any of the slide switch positions, depression of the pushbutton by manual force along the axis 24 causes depression of the resilient contact element 40 and engagement of contact end 46 with contact 38*d* to cause switch closure for as long as the pushbutton remains depressed. Upon manual release of the pushbutton, the spring action of element 40 causes separation of the switch contacts 46 and 38*d* and return of the resilient contact element 40 to its normally open position.

Figure 2:
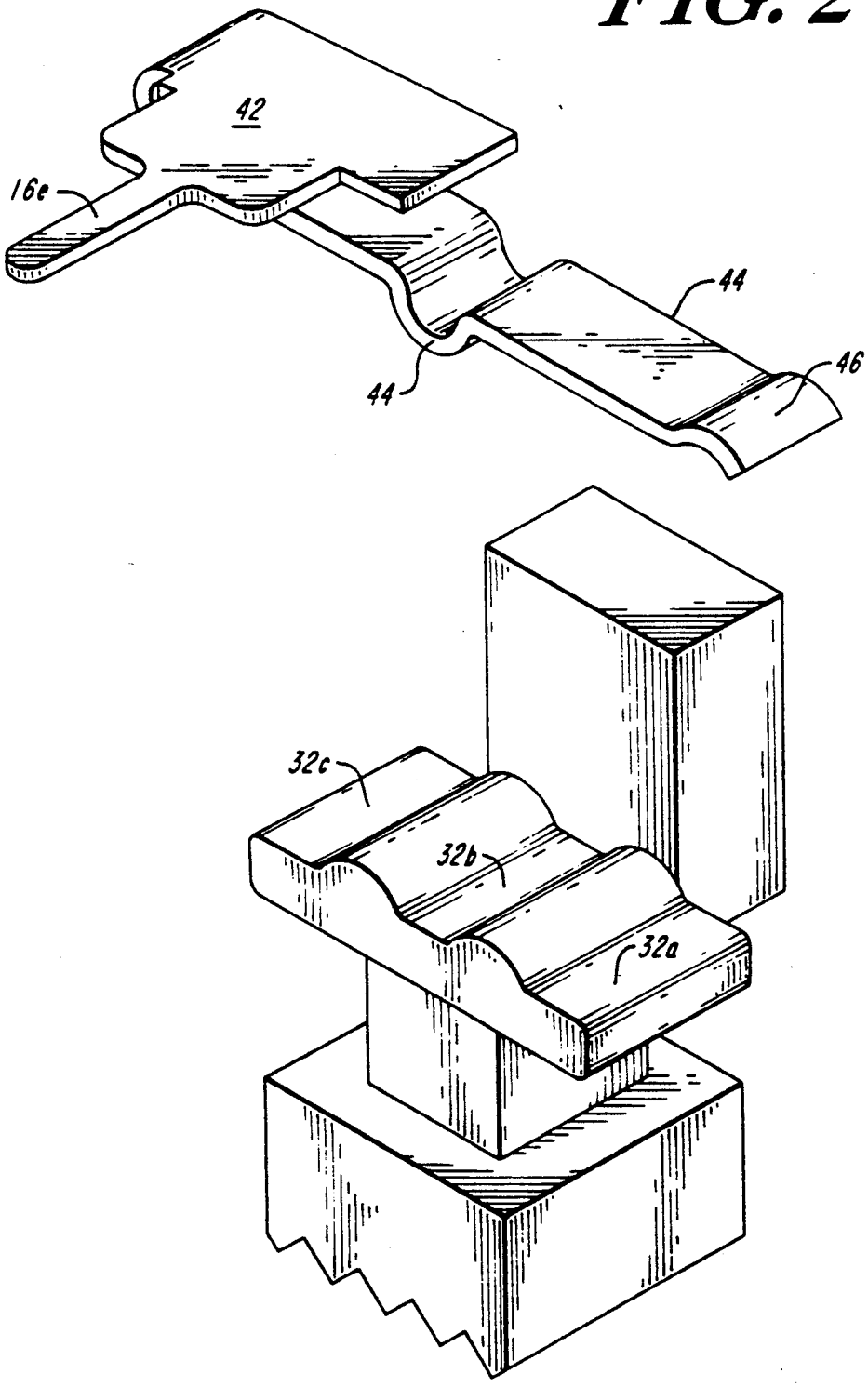
FIG. 2 is a partial exploded view illustrating the pushbutton assembly and cooperative leaf spring of the embodiment of FIG. 1.
Figure 10:
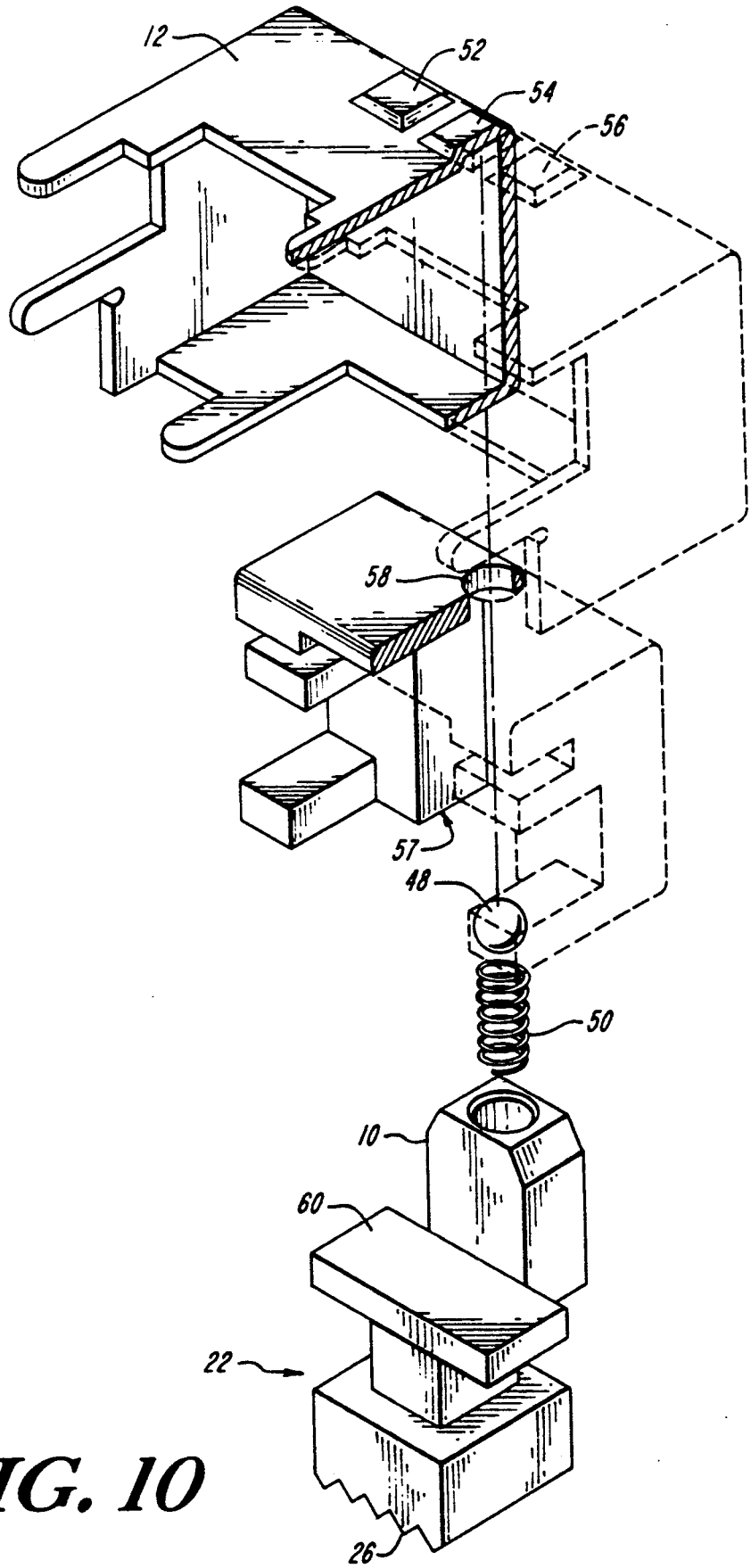
FIG. 10 is an exploded view of an alternate embodiment of the invention showing the ball and spring assembly incorporated in the pushbutton.
Figure 11:
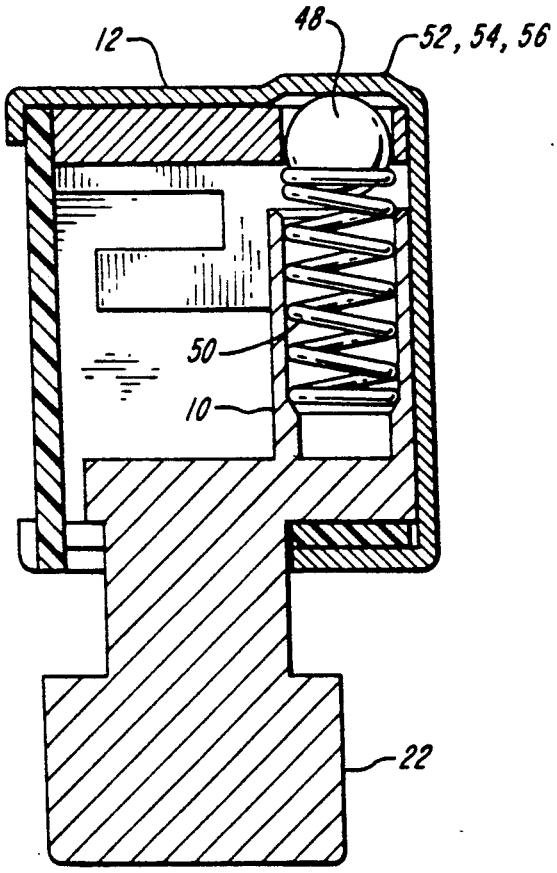
FIG. 11 is a cut-away side view of the alternate embodiment showing the ball and spring assembly disposed within the switch housing.

In an alternate embodiment shown in FIGS. 10 and 11, the slider assembly 10 includes a ball 48 and spring 50 that together serve as a detent means cooperative with a confronting wall of the switch housing 12. The confronting wall presents a series of ridges formed, in this embodiment, by three adjacent rectangular depressions 52,54,56 shown in FIG. 10. When the actuating end 26 of the pushbutton 22 is pushed laterally, the ball 48, biased by the spring 50, comes to rest in one of the depressions corresponding to each of three switch positions. In the embodiment of FIGS. 10 and 11, the pushbutton 22 omits the spaced recesses 32*a*, 32*b*, and 32*c* of FIG. 2, instead presenting a substantially flat surface 60 to the projecting portion 44 of the contact element 40. The ball 48 protrudes through a hole 58 to allow the ball to become seated in one of the three rectangular depressions 52, 54 and 56.

Figure 9:
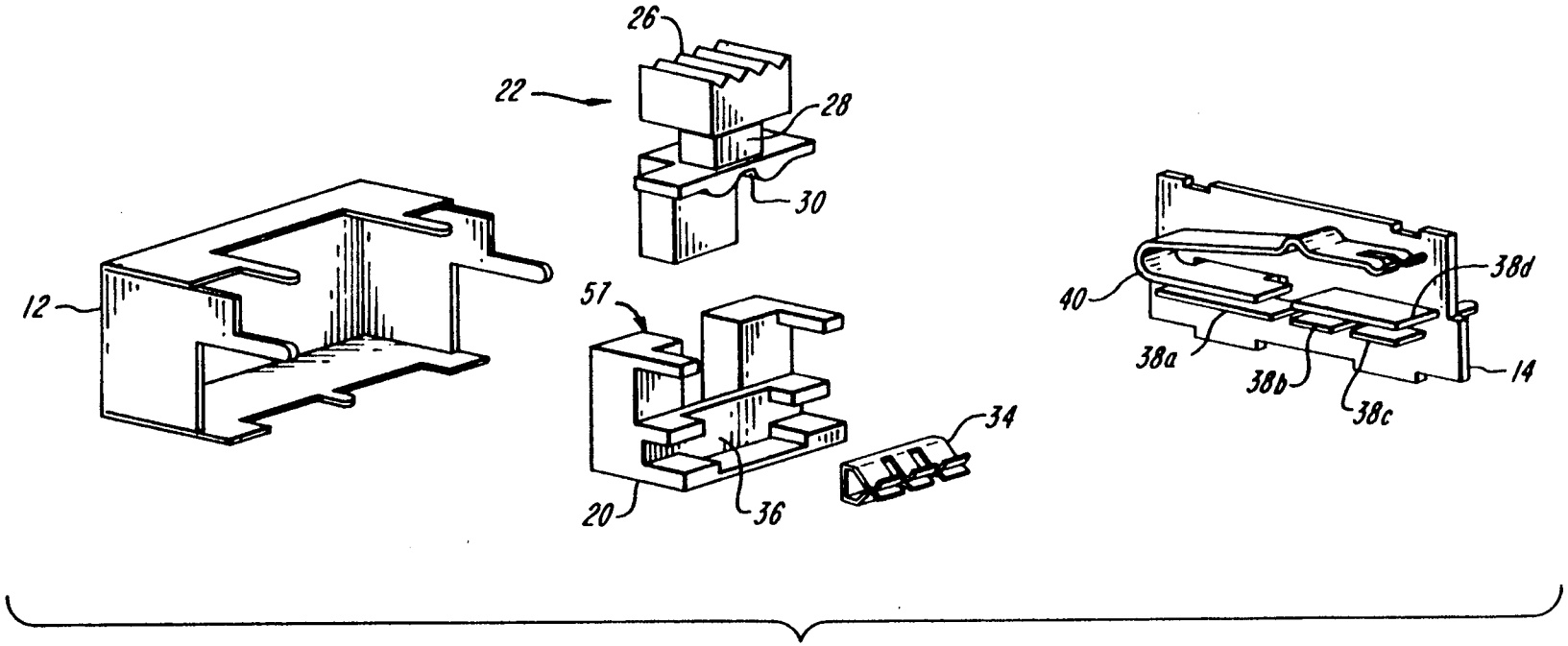
FIG. 9 is an exploded view of the switch and its housing.

Referring to FIGS. 9 and 10, the insulating body 20 has a channel 57 for supporting and carrying the pushbutton 22. The channel 57 also guides the pushbutton 22 so as to transmit a pushing force applied by a user to the flexible contact 40 to affect momentary switch activation. In a preferred embodiment, the channel 57 terminates with an opening 58 for allowing the ball 48 of the detent means to contact one of the three adjacent rectangular depressions 52, 54, and 56.

The novel switch of the invention contains fewer components than pushbutton slide switches of conventional construction, and the simplicity of the switch construction permits implementation in miniature form, as well as facilitating relatively low fabrication cost. The invention employs a single resilient element in distinction to the multiple ball an spring arrangement of prior art switches. The invention is not to be limited by what has been particularly shown and described except as indicated in the appended claims.

What is claimed is:

1. A momentary pushbutton slide switch comprising:

a slider assembly including a body of electrically insulative material, pushbutton means carried by the body and having an outer manual actuating end, an inner actuating portion and detent means, the pushbutton means being movable between an outward and an inward position, and a slide contact supported in the body and slidable therewith;

a mounting element;

a switch housing fixed to said mounting element including a wall in confronting relationship with said detent means, said wall including a ridged element;

a plurality of fixed contacts supported on said mounting element, selected ones of the fixed contacts being cooperative with the slide contact of the slider assembly to provide selective interconnection in at least one of the slider positions; and a leaf spring supported by the mounting element and having a contact portion cooperative with at least one of the fixed contacts, and an actuation portion;

the actuation portion of the leaf spring being cooperative with the inner actuating portion of the pushbutton means to provide momentary actuation of the contact portion of the leaf spring, and to provide cooperative fixed contact in one or more of the slider positions; and the ridged element of said wall of said switch housing being cooperative with the detent means of said pushbutton, the slider assembly being movable to respective slider positions defined by the ridged element of said wall and cooperative detent means of said pushbutton.

2. A momentary pushbutton slide switch comprising:

an insulating support plane;

a switch housing fixed to said support plane including a wall that has a ridged element;

a plurality of slider contacts disposed along a slider path and set into said insulating support plane;

a springy momentary contact assembly that includes a stationary contact set into said insulating support plane, and a flexible contact set into said insulating support plane, said flexible contact including a resiliently supported contact portion and a resiliently supported protruding actuating portion;

a slider assembly including:

an insulating body;

a sliding bridge contact supported and carried by said insulating body for selectively interconnecting said plurality of slider contacts disposed along said slider path;

a pushbutton supported and carried by said insulating body, and with a terminating switch-actuation portion that transmits a pushing force applied by a user, and detent means, said pushbutton providing:

a detent action in cooperation with said ridged element of said wall of said switch housing as said slider assembly is moved along said slider path by a user to selectively interconnect said plurality of slider contacts by means of said sliding bridge contact; and momentary switch actuation upon application of said pushing force by said user, wherein said insulating body includes a channel for supporting and carrying said pushbutton, and for guiding said pushbutton so as to transmit said pushing force to said flexible contact to affect said momentary switch actuation, and wherein said channel terminates with an opening for allowing said detent means to contact said ridged element of said wall of said switch housing.

3. The momentary pushbutton slide switch of claim 2 wherein said flexible contact is a leaf spring that includes a resiliently supported contact portion and a resiliently supported protruding actuating portion.

4. The momentary pushbutton slide switch of claim 2 wherein said sliding bridge contact is no larger than at least one of said plurality of slider contacts.

5. The momentary pushbutton slide switch of claim 2 wherein said detent means of said pushbutton includes a ball and spring assembly for providing slideably yielding resistance to lateral motion of said slider assembly.

6. The momentary pushbutton slide switch of claim 2 wherein said insulating body includes a recess for supporting and carrying said sliding bridge contact.

* * * * *

UNITED STATES PATENT AND TRADEMARK OFFICE

CERTIFICATE OF CORRECTION

PATENT NO. : 5,120,922
DATED : June 9, 1992
INVENTOR(S) : Peter F. Brouillette

It is certified that error appears in the above-indentified patent and that said Letters Patent is hereby corrected as shown below:

Column 3, line 9, "contact 38d" should read --contact 48--.

Signed and Sealed this
Seventh Day of June, 1994

*Attest:*

Bruce Lehman

BRUCE LEHMAN

*Attesting Officer*

*Commissioner of Patents and Trademarks*